US008147622B2

(12) United States Patent
Koshiba et al.

(10) Patent No.: US 8,147,622 B2
(45) Date of Patent: Apr. 3, 2012

(54) FE-BASED AMORPHOUS MAGNETIC ALLOY AND MAGNETIC SHEET

(75) Inventors: Hisato Koshiba, Tokyo (JP); Keiko Tsuchiya, Tokyo (JP); Kinshiro Takadate, Tokyo (JP)

(73) Assignee: Alps Green Devices Co. Ltd., Tokyo (JP)

( * ) Notice: Subject to any disclaimer, the term of this patent is extended or adjusted under 35 U.S.C. 154(b) by 494 days.

(21) Appl. No.: 11/956,706

(22) Filed: Dec. 14, 2007

(65) Prior Publication Data

US 2008/0142121 A1 Jun. 19, 2008

(30) Foreign Application Priority Data

Dec. 15, 2006 (JP) ..... 2006-338094
Aug. 10, 2007 (JP) ..... 2007-210306

(51) Int. Cl.
*H01F 1/153* (2006.01)

(52) U.S. Cl. ..... 148/304; 148/403

(58) Field of Classification Search ..... None
See application file for complete search history.

(56) References Cited

U.S. PATENT DOCUMENTS 4,126,287 A 11/1978 Mendelsohn et al.
6,656,292 B1 * 12/2003 Rabinkin et al. ..... 148/24
7,170,378 B2 * 1/2007 Fujiwara et al. ..... 336/83
2005/0034792 A1 * 2/2005 Lu et al. ..... 148/403
2007/0175545 A1 * 8/2007 Urata et al. ..... 148/304
2007/0258842 A1 * 11/2007 Lu et al. ..... 419/10

FOREIGN PATENT DOCUMENTS

| | | | |
|---|---|---|---|
| EP | 0 301 561 | | 2/1989 |
| EP | 0 747 498 | | 12/1996 |
| EP | 1 593 749 | | 11/2005 |
| JP | 11-71647 | | 3/1999 |
| JP | 2002-226956 | | 8/2002 |
| JP | 2005-60805 | * | 3/2005 |
| WO | WO 2005/020252 | * | 3/2005 |

OTHER PUBLICATIONS

The European Search Report for EP 07 02 4110 mailed May 8, 2008, 7 pages.

* cited by examiner

*Primary Examiner* — John Sheehan
(74) *Attorney, Agent, or Firm* — Hunton & Williams LLP

(57) ABSTRACT

Embodiments of the present disclosure are directed to an Fe-based amorphous magnetic alloy and method that includes 4 at. % or less of a low temperature annealing-enabling element M and 10 at. % or less of nickel (Ni). The total amount of the low temperature annealing-enabling element M and nickel (Ni) may be 2 at. % or more and 10 at. % or less.

8 Claims, 8 Drawing Sheets

FE-BASED AMORPHOUS MAGNETIC ALLOY AND MAGNETIC SHEET

CROSS-REFERENCE TO RELATED APPLICATIONS

This application claims benefit of Japanese Patent Application No. 2006-338094 filed on Dec. 15, 2006, and Japanese Patent Application No. 2007-210306 filed on Aug. 10, 2007, which are hereby incorporated by reference.

BACKGROUND OF THE DISCLOSURE

1. Field of the Disclosure

Embodiments of the present disclosure relate to Fe-based amorphous magnetic alloys and magnetic sheets. In particular, embodiments of the present disclosure relate to an Fe-based amorphous magnetic alloy having a large imaginary part μ" of complex permeability for use in a highly flexible magnetic sheet and a magnetic sheet incorporating the Fe-based amorphous magnetic alloy.

2. Description of the Related Art

Generally, alloys based on TM-Al—Ga—P—C—B—Si (TM represents a transition metal element such as Fe, Co, or Ni) and/or other similar element form amorphous phases and become amorphous soft magnetic alloys by being quenched in a molten state. Techniques for fabricating magnetic materials with excellent magnetic properties may be developed by optimizing the composition of the amorphous soft magnetic alloys. An Fe-based amorphous magnetic alloy has been developed where the alloy may be used as a magnetic material with excellent magnetic properties, in particular, a magnetic material having a large imaginary part μ" of complex permeability (refer to Japanese Unexamined Patent Application Publication No. 2002-226956).

Portable electronic devices such as cellular phones and laptop computers are increasingly used. These portable electronic devices face problems of electromagnetic wave interference, and there is increasing need for measures for preventing generation of unwanted high-frequency electromagnetic waves. In order to suppress unwanted electromagnetic waves, attaching a magnetic sheet to an electronic device that generates unwanted electromagnetic waves is effective. This magnetic sheet is prepared by forming particles of several to several tens of micrometers in size from the above-described Fe-based amorphous magnetic alloy by a water atomization process or the like, flattening the particles, kneading the resulting particles with a matrix material (insulating resin) such as polyethylene chloride serving as a binder, and forming the resulting mixture into sheets of several tens to several hundred micrometers in thickness by a doctor blade technique. This magnetic sheet preferably has a complex permeability with a large imaginary part μ" in the operation frequency band.

The imaginary part μ" of complex permeability of the Fe-based amorphous magnetic alloy may be increased by annealing. The problem associated with this is that when the glass transition temperature (Tg), the crystallization temperature (Tx), and the melting temperature (Tm) of the Fe-based amorphous magnetic alloy are high, the annealing temperature must be also high. Accordingly, when the Fe-based amorphous magnetic alloy is used in the magnetic sheet, the matrix material may become thermally decomposed and deteriorated, resulting in embrittlement of the magnetic sheet.

SUMMARY OF THE DISCLOSURE

Embodiments of the present disclosure provides an Fe-based amorphous magnetic alloy having relatively low glass transition temperature, crystallization temperature, and melting temperature such that the annealing temperature may be low, and a magnetic sheet having excellent flexibility even after annealing.

An Fe-based amorphous magnetic alloy of the present disclosure may contain 4 at. % or less of a low temperature annealing-enabling element M and 10 at. % or less of Ni. The total amount of the low temperature annealing-enabling element M and Ni may be 2 at. % or more and 10 at. % or less.

According to this composition, the Fe-based amorphous magnetic alloy may exhibit relatively low glass transition temperature (Tg), crystallization temperature (Tx), and melting temperature (Tm) and excellent flexibility suitable for use in a magnetic sheet.

The Fe-based amorphous magnetic alloy of the present disclosure may include at least one of tin (Sn), Indium (In), zinc (Zn), gallium (Ga), and aluminum (Al) as the low temperature annealing-enabling element M.

Additionally, in another embodiment, the Fe-based amorphous magnetic alloy may contain 1 at. % or more and 4 at. % or less of the low temperature annealing-enabling element M and 1 at. % or more and 10 at. % or less Ni. According to this composition, an Fe-based amorphous magnetic alloy having amorphous structures may be more stably produced.

The Fe-based amorphous magnetic alloy may have a composition represented by a compositional formula $Fe_{100-a-b-x-y-z-w-t}M_aNi_bCr_xP_yC_zB_wSi_t$, where the parameters may be as follows: $0<a\leqq 4$ at. %, $0<b\leqq 10$ at. %, $0\leqq x\leqq 4$ at. %, 6 at. %$\leqq y\leqq 13$ at. %, 2 at. %$\leqq z\leqq 12$ at. %, $0\leqq w\leqq 5$ at. %, and $0\leqq t\leqq 4$ at. %.

Other parameters may also be provided. For example, in one embodiment, the parameters may be as follows: $1\leqq a\leqq 4$ at. %, $1\leqq b<10$ at. %, $2<a+b\leqq 10$ at. %, $1\leqq x\leqq 8$ at. %, $6\leqq y\leqq 11$ at. %, $6\leqq z\leqq 11$ at. %, $0\leqq w\leqq 2$ at. %, and $0\leqq t<2$ at. %). In another embodiment, the parameters may be as follows: $1.5\leqq a\leqq 3.5$ at. %, $2\leqq b\leqq 7$ at. %, $3\leqq a+b\leqq 9.5$, and $2\leqq x\leqq 4$ at. %.

A magnetic sheet of the present disclosure may include a matrix material and the Fe-based amorphous magnetic alloy described above, the Fe-based amorphous magnetic alloy being contained in the matrix material.

In this manner, the magnetic sheet may have a large imaginary part μ" of complex permeability in the operation frequency band and excellent flexibility.

Also, the magnetic sheet may be annealed at a temperature of 400° C. or less.

DESCRIPTION OF THE PREFERRED EMBODIMENTS

Figure 1:
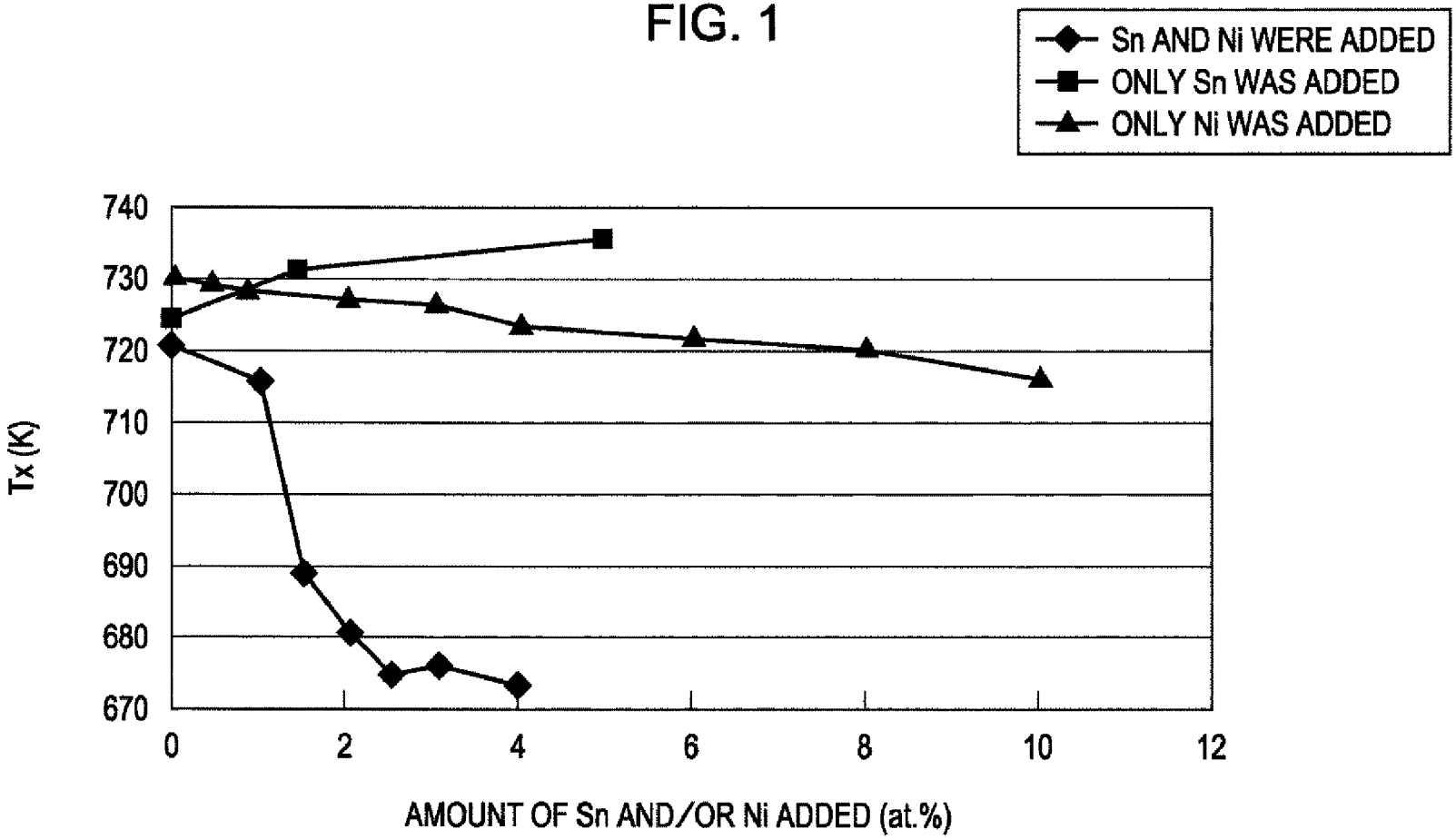
FIG. 1 depicts a graph showing the relationship between the crystallization temperature (Tx) and the amount of the low temperature annealing-enabling element M and/or Ni added to the Fe-based amorphous magnetic alloy, in accordance with an embodiment of the present disclosure.

Embodiments of the present disclosure will now be described in detail with reference to attached drawings.

The Fe-based amorphous magnetic alloy of the present disclosure may contain 4 at. % or less of an element M that enables low-temperature annealing (also referred to as "low temperature annealing-enabling element M" hereinafter) and 10 at. % or less of Ni, where the total content of M and Ni is 2 at. % or more and 10 at. % or less. The low temperature annealing-enabling element M may be an element that may decrease the glass transition temperature (Tg), the crystallization temperature (Tx), and the melting temperature (Tm) of the Fe-based amorphous magnetic alloy once it is used in combination with Ni.

The low temperature annealing-enabling element M may have a melting temperature lower than that of Fe. It is considered that incorporation of the low temperature annealing-enabling element M and Ni in the Fe-based alloy shifts the overall thermal profile toward the lower temperature side, and the Tg, Tx, and Tm become tower than those of existing Fe-based alloys. Examples of the low temperature annealing-enabling element M may include tin (Sn), Indium (In), zinc (Zn), gallium (Ga), and aluminum (Al).

The Fe-based amorphous magnetic alloy of the present disclosure may be represented by formula $Fe_{100-a-b-x-y-z-w-t}M_aNi_bCr_xP_yC_zB_wSi_t$ (where $0<a\leqq 4$ at. % $0<b\leqq 10$ at. %, $0\leqq x\leqq 4$ at. % 6 at. %$\leqq y\leqq 13$ at. %, 2 at. %$\leqq z\leqq 12$ at. %, $0\leqq w\leqq 5$ at. %, and $0\leqq t\leqq 4$ at. %)

As described above, the low temperature annealing-enabling element M used in combination with Ni may decrease the crystallization temperature (Tx) and the melting temperature (Tm). As a result, the annealing temperature may be decreased. The amount a of the low temperature annealing enabling element M may be $0\leqq a\leqq 4$ at. % in the above formula from the point of view of yielding an amorphous state. The total content of the M and Ni may be 2 at. % or more and 10 at. % or less, and/or more specifically, 3 at. % or more and 9.5 at. % or less.

Substitution of Fe by Ni may decrease the glass transition temperature (Tg), the crystallization temperature (Tx), and the melting temperature (Tm) From the standpoint of achieving preferable saturation magnetization and melting temperature (Tm), the Ni content b may be $0\leqq b\leqq 10$ at. %, and/or more specifically, 2 at. %$\leqq b\leqq 7$ at. % in the above-described formula.

The Cr content x may be $0\leqq x\leqq 8$ at. %, and/or more specifically, 2 at. %$\leqq x\leqq 4$ at. % in the above formula from the standpoints of achieving optimal corrosion resistance, thermal stability, and saturation magnetization of the alloy. The corrosion resistance in salt water immersion may be improved by adding 4 at. % of Cr. Since the amorphous phase may be stably produced and the magnetization intensity ($\sigma s$) may be decreased by increasing the melting temperature (Tm), the Cr content may be 4 at. %.

The P content y may be preferably 6 at. %$\leqq y\leqq 13$ at. %, and/or more specifically, 6 at. %$\leqq y\leqq 11$ at. % in the above formula from the viewpoint that the P content may be relatively near the Fe—P—C ($Fe_{79.4}P_{10.8}C_{9.8}$) eutectic composition.

The C content z may be 2 at. %$\leqq z\leqq 12$ at. %, and/or more specifically, 6 at. %$\leqq z\leqq 11$ at. % in the above formula from the viewpoint that the C content is preferably near the Fe—P—C ($Fe_{79.4}P_{10.8}C_{9.8}$) eutectic composition.

The B content w may be $0\leqq w\leqq 5$ at. %, and/or more specifically, $0\leqq w\leqq 2$ at. % in the above formula since B increases the glass transition temperature (Tg), the crystallization temperature (Tx) and the melting temperature (Tm). In order to enhance the amorphous phase formation ability, the B content may also be $1\leqq w\leqq 2$ at. %.

The Si content t may be $0\leqq t\leqq 4$ at. % and/or more specifically, $0\leqq t\leqq 2$ at. % in the above formula since Si increases the glass transition temperature (Tg), the crystallization temperature (Tx) and the melting temperature (Tm). As with B, the Si content may be $1\leqq t\leqq 2$ at. % to enhance amorphous phase formation ability.

The Fe-based amorphous magnetic alloy may be used in a magnetic sheet. The magnetic sheet may contain a matrix material and the Fe-based amorphous magnetic alloy in the matrix material.

Examples of the matrix material may include silicone resin, polyvinyl chloride, silicone rubber, phenolic resin, melamine resin, polyvinyl alcohol, polyethylene chloride, and various types of elastomers. In particular, since the Fe-based amorphous magnetic alloy is blended into the resin solution to prepare sheets, a resin capable of making an emulsion of the Fe-based amorphous magnetic alloy may be the matrix material. An example of such a resin may be silicone resin. Note that addition of a lubricant containing a stearate or the like to the matrix material facilitates formation of flat magnetic materials, and an Fe-based amorphous magnetic alloy having a high aspect ratio may be obtained in this manner. As a result, the particles of the Fe-based amorphous magnetic alloy in the magnetic sheet may stack in the sheet thickness direction and may easily become oriented. The density may also increased. Accordingly, the imaginary part μ" of the complex permeability increases, and the noise suppression characteristics may be improved.

The Fe-based amorphous magnetic alloy used in the magnetic sheet may be in the form of flat particles or powder. Powder or particles having an average aspect ratio (major axis/thickness) of 2.5 or more, and/or more specifically, 12 or more, may be preferred as such flat particles or powder from the standpoint of achieving an optimal degree of orientation and noise suppression characteristics. When the flat powder or particles have a higher degree of orientation, the density of the magnetic sheet and the imaginary part μ" of the complex permeability may be increased, and thus the noise suppression characteristics may be improved. A high aspect ratio may suppress generation of eddy current, resulting in an increased inductance, and may increase the imaginary part μ" of the complex permeability in the GHz band. From the standpoint of sheet production, the average aspect ratio is 80 or less and preferably 60 or less since sheet formation becomes difficult at an excessively large aspect ratio.

The magnetic sheet may be produced as follows. First, a melt of the Fe-based amorphous magnetic alloy may be sprayed into water and quenched to produce alloy particles (water atomization technique). Note that the technique for making the Fe-based amorphous magnetic alloy particles may not be limited to this water atomization technique, and various other techniques such as a gas atomization technique, a liquid quenching technique in which ribbons of quenched alloy melt are pulverized to form alloy powder, or other similar techniques, may also be employed. Processing conditions for the water atomization technique, the gas atomization technique, and the liquid quenching technique may be typical conditions selected according to the types of raw materials.

After the resulting Fe-based amorphous magnetic alloy particles are classified to make the particle size uniform, the alloy particles may be flattened with an attritor or the like as needed. The attritor may include a drum containing many balls used for disintegration and may process the Fe-based amorphous magnetic alloy particles to have a target flatness by mixing and agitating the Fe-based amorphous magnetic alloy powder with the balls. The flat particles of Fe-based amorphous magnetic alloy may also be obtained by the liquid quenching technique described above. The resulting Fe-based amorphous magnetic alloy particles may be heated to reduce the internal stress, if necessary.

Next, a magnetic sheet containing the Fe-based amorphous magnetic alloy may be made. In making the magnetic sheet, a liquid mixture containing a liquid matrix material of the magnetic sheet and the Fe-based amorphous magnetic alloy may be prepare and then the liquid mixture may be formed into sheets. The resulting magnetic sheet may then be annealed.

EXEMPLARY EXAMPLES

The experiments conducted to confirm the effects of the present disclosure will now be described.

Experimental Example 1

Characteristics of Fe-Based Amorphous Magnetic Alloy

Spherical particles 1 μm to 100 μm in size were prepared by the water atomization technique by using FePC as the base material and by adding M, Ni, Cr, B, Si, and/or other suitable elements to the base material. The particles were classified so that the average particle size (D50) was 22 to 25 μm, and the resulting particles were flattened with a disintegrator such as an attritor to form flat Fe-based amorphous magnetic alloy particles. The glass transition temperature (Tg), the crystallization temperature (Tx), and the melting temperature (Tm) of the particles were measured with a differential scanning calorimeter (DSC). The saturation magnetization (σs) was determined with a vibrating sample magnetometer (VSM).

The resulting Fe-based amorphous magnetic alloy particles were mixed with a silicone resin to prepare a mixture having an Fe-based amorphous magnetic alloy content of 44 vol. %. The mixture was formed into noise suppression sheets (magnetic sheets) having a thickness of about 0.1 mm. The magnetic sheets were placed in an annealing furnace and annealed in an nitrogen atmosphere at an annealing temperature (Ta) of 300° C. to 420° C. (a temperature that may sufficiently increase the imaginary part (μ") of the complex permeability or the fracture strain (λf)) The temperature profile was as follows: rate of temperature elevation: 10° C./min, retention time: 30 minutes. The magnetic sheets were then furnace-cooled. The imaginary part (μ") of the complex permeability at 1 GHz of the resulting magnetic sheets was measured with an E4991A produced by Agilent. The fracture strain λf was measured by the process described below As previously mentioned, the imaginary part μ" of the complex permeability of the Fe-based amorphous magnetic alloy of the present disclosure may be increased by annealing. At an excessively high annealing temperature, the magnetic sheet prepared from the Fe-based amorphous magnetic alloy may undergo embrittlement. Embrittlement of the magnetic sheet may be evaluated in terms of flexibility based on fracture strain λf.

Figure 4:
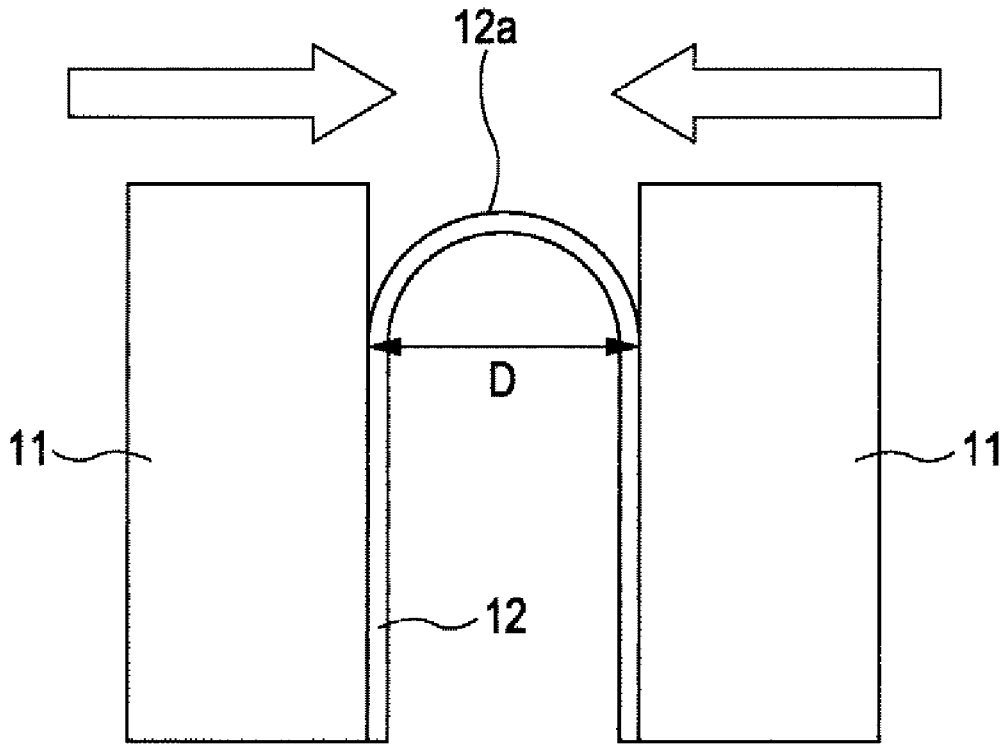
FIG. 4 depicts a diagram showing a fixture used to measure the fracture strain of magnetic sheets, in accordance with an embodiment of the present disclosure.

FIG. 4 depicts a fixture for measuring the fracture strain λf, in accordance with an embodiment of the present disclosure. In measuring the fracture strain λf, a magnetic sheet 12 may be bent and held between a pair of parallel blocks 11, and the distance D between the parallel blocks 11 is decreased in the direction of arrows. The bending diameter at which a crack occurs in a bent region 12*a* of the magnetic sheet 12 may be assumed to be the fracture limitation diameter Df. The fracture strain λf may then be determined from Equation (1) below:

$$\lambda f = t/(Df-t) \quad (1)$$

where Df represents the fracture limit diameter and t represents the thickness of the magnetic sheet 12.

The magnetic sheet in a completely bent state (the state in which the magnetic sheet is folded in two without cracks) may have Df of 2 t and the maximum value of λf may be 1. The flexibility of the magnetic sheet may be rated on the basis of λf. The closer λf is to 1, the higher the flexibility of the magnetic sheet. In application, λf may be required to be at least 0.1 to facilitate handling, and λf may also be 0.2or more. For example, in order for a magnetic sheet having a thickness of 0.1 mm to satisfy λf>0.1, the temperature of annealing the magnetic sheet may be 400° C. or less.

Annealing the magnetic sheet causes structural relaxation in the Fe-based amorphous magnetic alloy and releases the strain generated during sheet formation. In this manner, the imaginary part μ" of the complex permeability may increase in the operation frequency band, and superior noise suppression effects may be achieved. In application, the imaginary part μ" of the complex permeability may be 15 or more at 1 GHz.

The results are shown in Table 1. In the table, samples noted as "Ex." may be within the range of the embodiments of the present disclosure and samples noted as "Co." may be outside the range of the embodiments of the present disclosure. In the present disclosure, the melting temperature (Tm) may be relatively low to reduce the annealing temperature. In the table, the compositions that meet this requirement are given.

TABLE 1

| No. | Composition | Structure | Tg/K | Tx/K | ΔTx/K | Tm/K | Tg/Tm | Tx/Tm | σs ($\times 10^{-6}$ Wbm/kg) | μ" (1 GHz) | λf | |
|---|---|---|---|---|---|---|---|---|---|---|---|---|
| 1 | $Fe_{68.9}Sn_1Ni_6Cr_4P_{9.8}C_{7.3}B_2Si_1$ | Amorphous | — | 716 | — | 1286 | — | 0.56 | 164 | 18.5 | 0.23 | Ex. |
| 2 | $Fe_{68.4}Sn_{1.5}Ni_6Cr_4P_{9.8}C_{7.3}B_2Si_1$ | Amorphous | — | 689 | — | 1281 | — | 0.54 | 160 | 21.5 | 0.24 | Ex. |
| 3 | $Fe_{67.9}Sn_2Ni_6Cr_4P_{9.8}C_{7.3}B_2Si_1$ | Amorphous | — | 681 | — | 1289 | — | 0.53 | 152 | 22.3 | 0.25 | Ex. |
| 4 | $Fe_{67.4}Sn_{2.5}Ni_6Cr_4P_{9.8}C_{7.3}B_2Si_1$ | Amorphous | — | 675 | — | 1282 | — | 0.53 | 150 | 19.5 | 0.25 | Ex. |
| 5 | $Fe_{67.4}In_{2.5}Ni_6Cr_4P_{9.8}C_{7.3}B_2Si_1$ | Amorphous | — | 670 | — | 1275 | — | 0.53 | 148 | 22.7 | 0.30 | Ex. |
| 6 | $Fe_{67.4}Zn_{2.5}Ni_6Cr_4P_{9.8}C_{7.3}B_2Si_1$ | Amorphous | — | 680 | — | 1288 | — | 0.53 | 150 | 23.0 | 0.29 | Ex. |
| 7 | $Fe_{66.9}Sn_3Ni_6Cr_4P_{9.8}C_{7.3}B_2Si_1$ | Amorphous | — | 676 | — | 1261 | — | 0.54 | 143 | 19.2 | 0.29 | Ex. |
| 8 | $Fe_{65.9}Sn_4Ni_6Cr_4P_{9.8}C_{7.3}B_2Si_1$ | Amorphous | — | 672 | — | 1259 | — | 0.53 | 138 | 24.0 | 0.35 | Ex. |
| 9 | $Fe_{74.9}Sn_{1.5}Ni_3P_{10.8}C_{8.8}B_1$ | Amorphous | 685 | 713 | 28 | 1223 | 0.56 | 0.58 | 190 | 18.5 | 0.21 | Ex. |
| 10 | $Fe_{70.4}Sn_{1.5}Ni_3Cr_4P_{10.8}C_{8.8}B_1$ | Amorphous | 659 | 704 | 45 | 1263 | 0.52 | 0.56 | 153 | 19.0 | 0.25 | Ex. |
| 11 | $Fe_{66.9}Sn_3Ni_6Cr_4P_{9.8}C_{7.3}B_2Si_1$ | Amorphous | — | 676 | — | 1261 | — | 0.54 | 143 | 21.5 | 0.27 | Ex. |
| 12 | $Fe_{71.4}Sn_2Ni_3Cr_3P_{10.8}C_{8.8}B_1$ | Amorphous | 655 | 694 | 39 | 1276 | 0.51 | 0.54 | 160 | 22.0 | 0.50 | Ex. |
| 13 | $Fe_{67.9}Sn_{3.5}Ni_4Cr_4P_{10.8}C_{9.8}$ | Amorphous | — | 662 | — | 1256 | — | 0.53 | 141 | 22.5 | 0.32 | Ex. |
| 14 | $Fe_{65.9}Sn_{3.5}Ni_6Cr_4P_{10.8}C_{9.8}$ | Amorphous | — | 662 | — | 1255 | — | 0.53 | 137 | 24.0 | 0.35 | Ex. |
| 15 | $Fe_{67.9}Sn_{3.5}Ni_4Cr_4P_{8.8}C_{9.8}Si_2$ | Amorphous | — | 675 | — | 1225 | — | 0.55 | 143 | 23.0 | 0.30 | Ex. |
| 16 | $Fe_{67.9}Sn_{3.5}Ni_4Cr_4P_{8.8}C_{10.8}B_1$ | Amorphous | — | 668 | — | 1231 | — | 0.54 | 137 | 18.1 | 0.22 | Ex. |
| 17 | $Fe_{72.4}Sn_2Ni_5P_{10.8}C_{2.2}B_{4.2}Si_{3.4}$ | Amorphous | — | 706 | — | 1278 | — | 0.55 | 186 | 18.5 | 0.24 | Ex. |
| 18 | $Fe_{79.4}P_{10.8}C_{9.8}$ | Amorphous | 681 | 711 | 30 | 1241 | 0.55 | 0.57 | 199 | 14.5 | 0.20 | Co. |
| 19 | $Fe_{64.9}Sn_5Ni_6Cr_4P_{9.8}C_{7.3}B_2Si_1$ | Partly crystalline | — | — | — | — | — | — | 130 | 10.5 | 0.20 | Co. |
| 20 | $Fe_{70.9}Sn_5Cr_4P_{9.8}C_{7.3}B_2Si_1$ | Amorphous | 716 | 748 | 32 | 1265 | 0.57 | 0.59 | 152 | 14.8 | 0.20 | Co. |
| 21 | $Fe_{75.9}Cr_4P_{9.3}C_{6.8}B_2Si_1$ | Amorphous | 672 | 724 | 52 | 1266 | 0.53 | 0.57 | 178 | 16.0 | 0.18 | Co. |
| 22 | $Fe_{75.4}Sn_{1.5}Cr_4P_{9.3}C_{6.8}B_2Si_1$ | Amorphous | 706 | 731 | 25 | 1271 | 0.56 | 0.58 | 163 | 14.5 | 0.18 | Co. |
| 23 | $Fe_{71.9}Sn_5Cr_4P_{9.3}C_{6.8}B_2Si_1$ | Amorphous | 707 | 735 | 26 | 1273 | 0.56 | 0.58 | 157 | 15.2 | 0.20 | Co. |
| 24 | $Fe_{75.4}Sn_2Cr_2P_{10.8}C_{6.4}Si_{3.4}$ | Amorphous | 724 | 755 | 31 | 1273 | 0.58 | 0.61 | 177 | 16.0 | 0.21 | Co. |
| 25 | $Fe_{73.4}Ni_5P_{10.8}C_{2.2}B_{5.2}Si_{3.4}$ | Amorphous | 729 | 767 | 40 | 1292 | 0.56 | 0.59 | 200 | 14.9 | 0.21 | Co. |
| 26 | $Fe_{76.4}Cr_2P_{10.8}C_{2.2}B_{4.2}Si_{4.4}$ | Amorphous | 745 | 776 | 31 | 1308 | 0.57 | 0.59 | 182 | 14.9 | 0.20 | Co. |
| 27 | $Fe_{74.43}Cr_{1.96}P_{9.04}C_{2.16}B_{7.54}Si_{4.87}$ | Amorphous | 784 | 834 | 50 | 1294 | 0.61 | 0.64 | 180 | 14.0 | 0.20 | Co. |
| 28 | $Fe_{66.9}Sn_5Ni_4Cr_4P_{9.8}C_{7.3}B_2Si_1$ | Partly crystalline | — | — | — | — | — | — | 9 | 8.5 | 0.18 | Co. |
| 29 | $Fe_{68.9}Sn_5Ni_2Cr_4P_{9.8}C_{7.3}B_2Si_1$ | Partly crystalline | — | — | — | — | — | — | 11 | 11.3 | 0.20 | Co. |
| 30 | $Fe_{69.9}Ni_6Cr_4P_{9.8}C_{7.3}B_2Si_1$ | Amorphous | 697 | 721 | 24 | 1292 | 0.54 | 0.56 | 163 | 18.8 | 0.18 | Co. |

In Table 1, Sample Nos. 18 to 30 represent comparative examples in which the crystallization temperature (Tx) exceeds 720 K, the imaginary part (μ") of the complex permeability is less than 15, or the fracture strain λf is less than 0.2. In contrast, Sample Nos. 1 to 17 all satisfy the required characteristics described above. In particular, the annealing temperature may be decreased to 400° C. (673 K) or lower if the crystallization temperature (Tx) is 720 K or less. Sample Nos. 2, 3, 5, 6, 8, and 15 exhibited μ" exceeding 20, and their magnetic properties are also satisfactory. Sample No. 12 has λf reaching 0.5, and an imaginary part (μ") of the complex permeability exceeding 20. Sample No. 12 has superior characteristics.

In the table, the samples having the glass transition temperature (Tg) column unfilled may be samples that do not have any glass transition temperature. Although a material having a glass transition temperature (Tg) forms an alloy that may easily form amorphous phases, the glass transition temperature (Tg) and the crystallization temperature (Tx) may tend to be high, and this may require higher annealing temperature. This tendency may be apparent from the results of Table 1.

Experimental Example 2

Effects of Adding both Sn and Ni

FIG. 1 depicts a graph showing the relationship between the crystallization temperature (Tx) and the amount of the low temperature annealing-enabling element M and/or Ni added to the Fe-based amorphous magnetic alloy, in accordance with an embodiment of the present disclosure. In the graph, the plot indicated by rhombic symbols may be based on samples containing 6 at. % of Ni and Sn in an amount ranging from 1 to 4 at. %. That is, Sample Nos. 30, 1, 2, 3, 4, 7, and 8 in Table 1 are plotted in ascending order of the Sn content. The plot indicated by triangular symbols may be based on samples containing no Sn but 0 to 10 at. % of Ni. That is, Samples Nos. 31 to 38 having compositions shown in Table 2 are plotted in the ascending order.

In the graph, the profile indicated by square symbols may be based on samples not containing Ni but 0 to 5 at. % of Sn. That is, Sample Nos. 21, 22, and 23 in Table 1 are plotted in the ascending order of the Sn content.

TABLE 2

| No. | Composition | Tg/K | Tx/K | ΔTx/K | Tm/K | Tg/Tm | Tx/Tm | Structure |
|---|---|---|---|---|---|---|---|---|
| 31 | $Fe_{75.9}Cr_4P_{10.8}C_{6.3}B_2Si_1$ | 713.00 | 731 | 18 | 1266 | 0.563191153 | 0.58 | Amorphous |
| 32 | $Fe_{74.9}Ni_1Cr_4P_{10.8}C_{6.3}B_2Si_1$ | 713.00 | 729 | 16 | 1264 | 0.564082278 | 0.58 | Amorphous |
| 33 | $Fe_{73.9}Ni_2Cr_4P_{10.8}C_{6.3}B_2Si_1$ | 709.00 | 728 | 19 | 1262 | 0.561806656 | 0.58 | Amorphous |
| 34 | $Fe_{72.9}Ni_3Cr_4P_{10.8}C_{6.3}B_2Si_1$ | 706.00 | 727 | 21 | 1260 | 0.56031746 | 0.58 | Amorphous |
| 35 | $Fe_{71.9}Ni_4Cr_4P_{10.8}C_{6.3}B_2Si_1$ | 700.00 | 724 | 24 | 1258 | 0.556438792 | 0.58 | Amorphous |
| 36 | $Fe_{69.9}Ni_6Cr_4P_{10.8}C_{6.3}B_2Si_1$ | 697.00 | 722 | 25 | 1253 | 0.556264964 | 0.58 | Amorphous |
| 37 | $Fe_{67.9}Ni_8Cr_4P_{10.8}C_{6.3}B_2Si_1$ | 694.00 | 721 | 27 | 1270 | 0.546456693 | 0.57 | Amorphous |
| 38 | $Fe_{65.9}Ni_{10}Cr_4P_{10.8}C_{6.3}B_2Si_1$ | 689.00 | 717 | 28 | 1273 | 0.541241163 | 0.56 | Amorphous |

FIG. 1 shows that the crystallization temperature (Tx) of Fe-based amorphous magnetic alloys containing only one of Sn and Ni do not decrease or do not significantly decrease. In contrast, the crystallization temperature (Tx) of Fe-based amorphous magnetic alloys containing both Sn and Ni may decrease significantly. Thus, an Fe-based amorphous magnetic alloy containing the low temperature annealing-enabling element and Ni may have a lower crystallization temperature (Tx), and the annealing temperature may be decreased. The amount of Sn added may be 1 at. % or more as understood from FIG. 1 and Table 1. The amount of Sn may be 1.5 at. % or more to further enhance the effect of decreasing the crystallization temperature (Tx). Since addition of more than 4 at. % of Sn promotes crystallization, the Sn content may be 4 at. % or less, and/or more specifically, 3.5 at. % or less, to stably obtain amorphous alloys.

Experimental Example 3

Optimum Amounts of Element M and Ni

Figure 2:
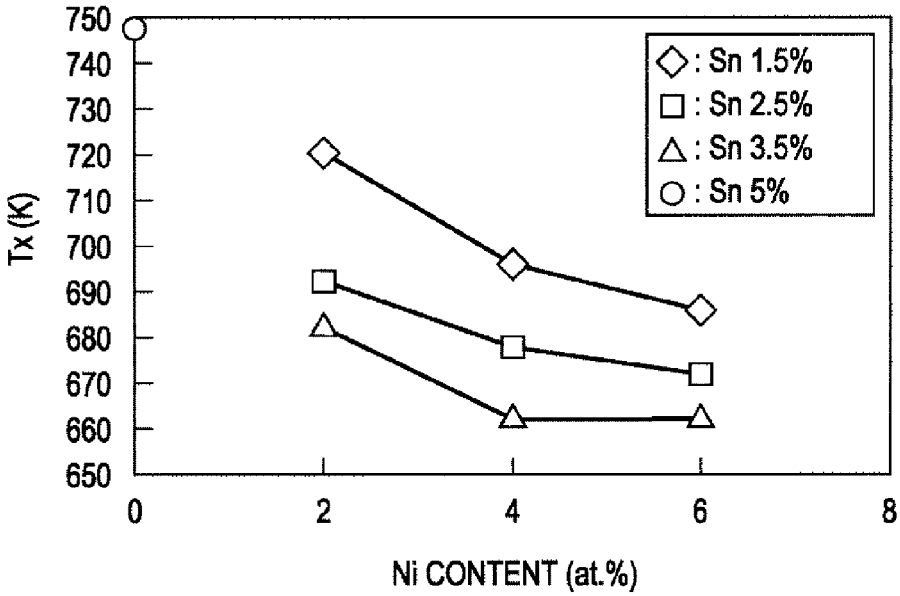
FIG. 2 depicts a graph showing the relationship between the crystallization temperature (Tx) and the amounts of the low temperature annealing-enabling element M and Ni added to the Fe-based amorphous magnetic alloy, in accordance with an embodiment of the present disclosure.
Figure 3:
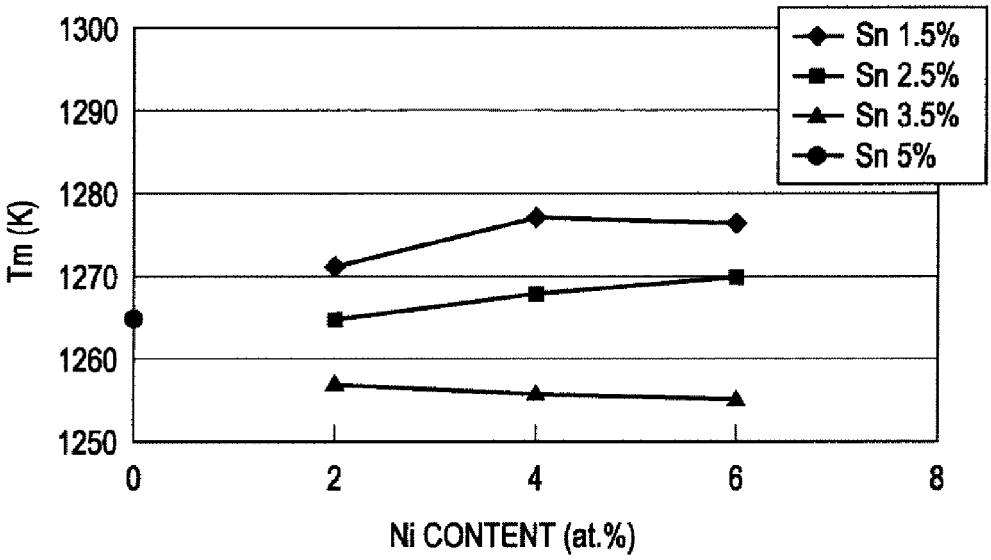
FIG. 3 depicts a graph showing the relationship between the melting temperature (Tm) and the amounts of the low temperature annealing-enabling element M and Ni added to the Fe-based amorphous magnetic alloy, in accordance with an embodiment of the present disclosure.

The optimum amounts of the low temperature annealing-enabling element and Ni in the Fe-based amorphous magnetic alloy will now be described. FIG. 2 depicts a graph showing the relationship between the crystallization temperature (Tx) and the amounts of the low temperature annealing-enabling element M and Ni added to the Fe-based amorphous magnetic alloy, in accordance with an embodiment of the present disclosure. Samples containing 1.5 at. % of Sn and 2 to 6 at. % of Ni, samples containing 2.5 at. % of Sn and 2 to 6 at. % of Ni, and samples containing 3.5 at. % of Sn and 2 to 6 at. % of Ni in Table 3 were plotted. Sample No. 48 in Table 3 containing 5 at. % of Sn and no Ni was also plotted in FIG. 2. FIG. 3 depicts a graph showing the relationship between the melting temperature (Tm) and the amounts of the low temperature annealing-enabling element M and Ni in the Fe-based amorphous magnetic alloy, in accordance with an embodiment of the present disclosure. The graph in FIG. 3 was plotted using the same samples as in the graph in FIG. 2 but with respect to melting temperature (Tm). The crystallization temperature (Tx) and the melting temperature (Tm) were determined as described above.

TABLE 3

| No. | Composition | Sn content | Ni content | Structure | Tg/K | Tx/K | ΔTx/K | Tm | Tg/Tm | Tx/Tm |
|---|---|---|---|---|---|---|---|---|---|---|
| 39 | $Fe_{71.9}Sn_{1.5}Ni_2Cr_4P_{10.8}C_{9.8}$ | 1.5 | 2 | Amorphous | 683 | 720 | 37 | 1271 | 0.54 | 0.556 |
| 40 | $Fe_{69.9}Sn_{1.5}Ni_4Cr_4P_{10.8}C_{9.8}$ | 1.5 | 4 | Amorphous | — | 695 | — | 1277 | — | 0.541 |
| 41 | $Fe_{67.9}Sn_{1.5}Ni_6Cr_4P_{10.8}C_{9.8}$ | 1.5 | 6 | Amorphous | — | 685 | — | 1276 | — | 0.549 |
| 42 | $Fe_{70.9}Sn_{2.5}Ni_2Cr_4P_{10.8}C_{9.8}$ | 2.5 | 2 | Amorphous | — | 691 | — | 1265 | — | 0.546 |
| 43 | $Fe_{66.9}Sn_{2.5}Ni_4Cr_4P_{10.8}C_{9.8}$ | 2.5 | 4 | Amorphous | — | 676 | — | 1268 | — | 0.533 |
| 44 | $Fe_{66.9}Sn_{2.5}Ni_6Cr_4P_{10.8}C_{9.8}$ | 2.5 | 6 | Amorphous | — | 670 | — | 1270 | — | 0.528 |
| 45 | $Fe_{69.9}Sn_{3.5}Ni_2Cr_4P_{10.8}C_{9.8}$ | 3.5 | 2 | Amorphous | — | 680 | — | 1257 | — | 0.541 |
| 46 | $Fe_{67.9}Sn_{3.5}Ni_4Cr_4P_{10.8}C_{9.8}$ | 3.5 | 4 | Amorphous | — | 662 | — | 1256 | — | 0.527 |
| 47 | $Fe_{65.9}Sn_{3.5}Ni_6Cr_4P_{10.8}C_{9.8}$ | 3.5 | 6 | Amorphous | — | 662 | — | 1255 | — | 0.527 |
| 48 | $Fe_{70.9}Sn_5Cr_4P_{9.8}C_{7.3}B_2Si_1$ | 5 | 0 | Amorphous | 716 | 748 | 32 | 1265 | 0.57 | 0.591 |

FIG. 2 shows that the Fe-based amorphous magnetic alloys of the present disclosure may exhibit a low crystallization temperature (Tx) when the amount of Sn, which may be the low temperature annealing-enabling element, is 3.5 at. % and the amount of Ni is 4 at. % or more. FIG. 3 shows that the Fe-based amorphous magnetic alloys of the present disclosure may exhibit a low melting temperature (Tm) when 3.5 at. % of Sn, which may be the low temperature annealing-enabling element, is contained. Since an amorphous state may be yielded within this content range, the amount of the low temperature annealing-enabling element may be 3.5 at. % and the amount of Ni may be 4 at. %.

Experimental Example 4

Relationship Between the Annealing Temperature and μ" and λf

Spherical particles 1 μm to 100 μm in size were prepared by a water atomization technique from an alloy melt of Sample No. 16 in Table 1. The particles were classified so that the average particle size (D50) was 22 to 25 μm, and the resulting particles were flattened with a disintegrator such as an attritor to form flat Fe-based amorphous magnetic alloy particles. The glass transition temperature (Tg) and the crystallization temperature (Tx) of the Fe-based amorphous magnetic alloy were measured with DSC. The glass transition temperature (Tg) was not detected. The crystallization temperature (Tx) was 395° C. (668 K).

The resulting Fe-based amorphous magnetic alloy particles were mixed into a silicone resin such that the Fe-based amorphous magnetic alloy content in the mixture was 44 vol. %. The mixture was formed into noise suppression sheets (magnetic sheets) having a thickness of about 0.1 mm. The magnetic sheets were placed in an annealing furnace and annealed in a nitrogen atmosphere at an annealing temperature (Ta) of 300° C. to 420° C. (573 to 693 K). The temperature profile was as follows: rate of temperature elevation: 10° C./min, retention time: 30 minutes. The magnetic sheets were then furnace-cooled. Thus, magnetic sheets of Examples were obtained.

Figure 5:
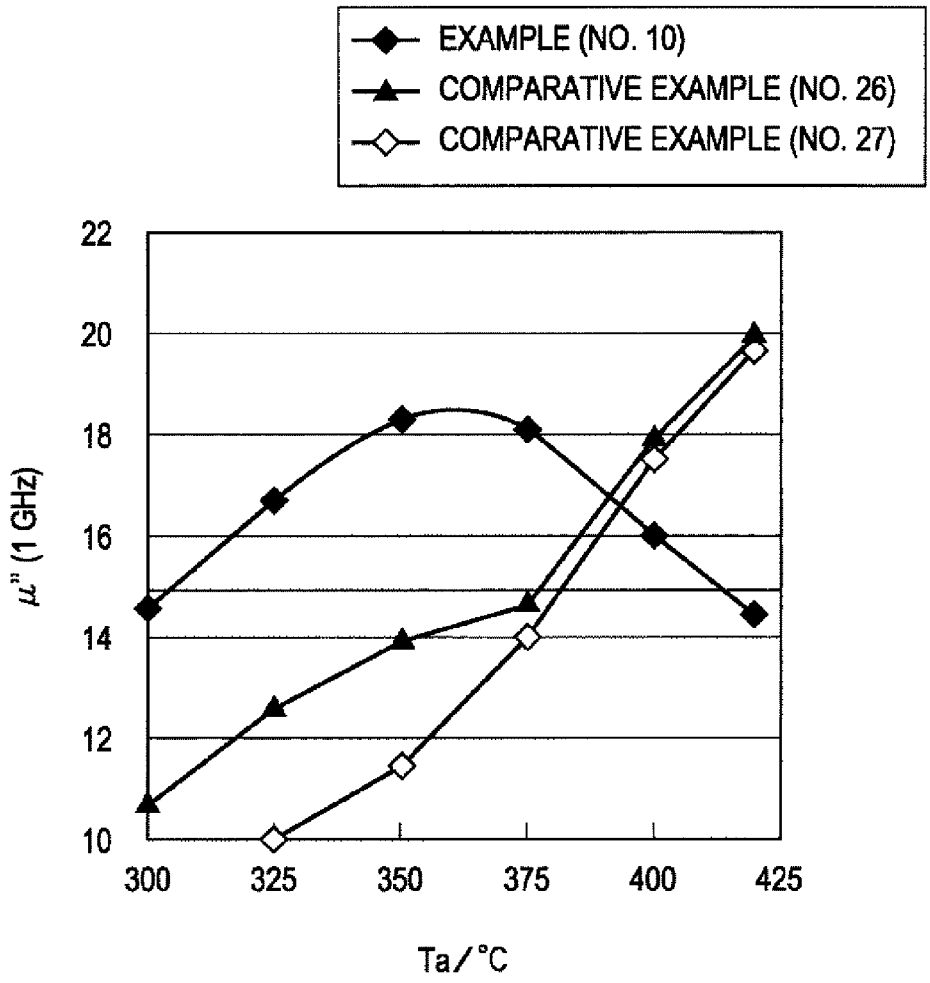
FIG. 5 depicts a characteristic diagram showing the relationship between the annealing temperature and the magnetic property, in accordance with an embodiment of the present disclosure.
Figure 6:
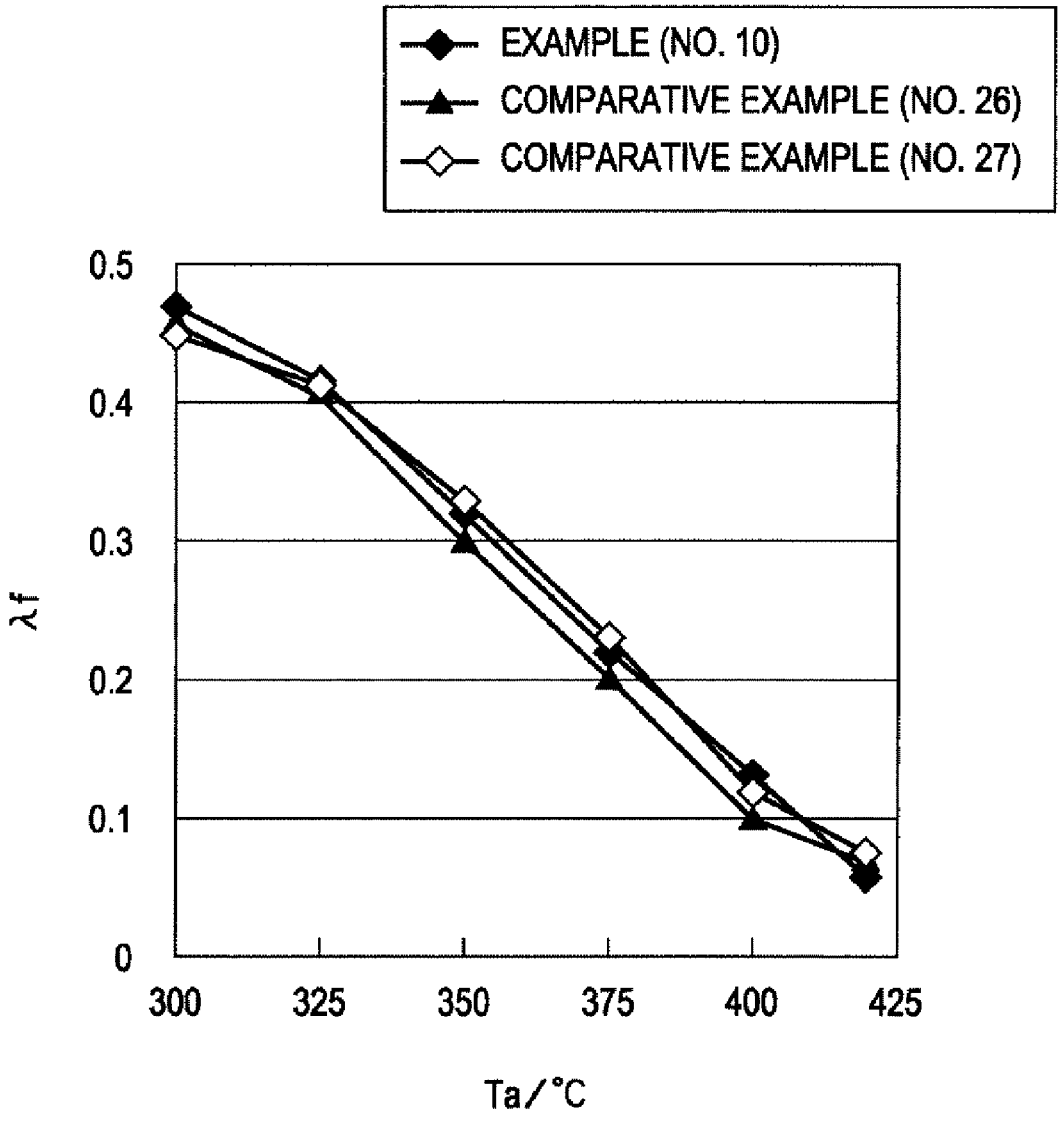
FIG. 6 depicts a characteristic diagram showing the relationship between the annealing temperature and the flexibility, in accordance with an embodiment of the present disclosure.

The magnetic sheets annealed at the above-described temperature were analyzed to determine the imaginary part μ" of the complex permeability at 1 GHz and the fracture strain λf. The results are shown in FIGS. 5 and 6. The fracture strain λf was determined from the fracture limitation diameter Df determined using the fixture shown in FIG. 4 and Equation (1) above. The imaginary part μ" of the complex permeability at 1 GHz was measured with an E4991A produced by Agilent.

As shown in FIG. 5, the imaginary part μ" of the complex permeability of the magnetic sheets of Examples annealed at a temperature in the range of 300° C. to 420° C. (573 to 693 K) was or more at 1 GHz, which was sufficient for practical application. As shown in FIG. 6, λf was sufficient for practical application, i.e., 0.1 or more, at an annealing temperature of 400° C. or less, and λf was at a desirable level, i.e., 0.2 or more, at an annealing temperature of 375° C. (648 K) or less.

Figure 7A:
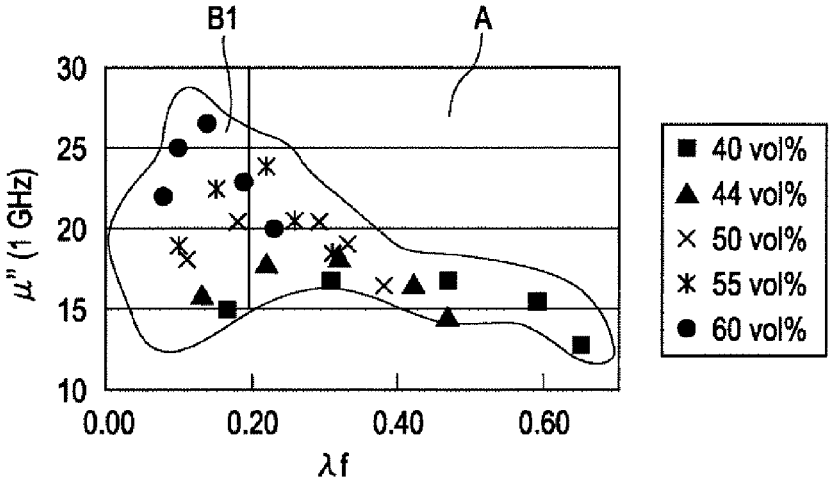
FIG. 7A depicts a graph showing the relationship between the region where the magnetic property and the flexibility are at desired levels and the region covering the magnetic property and the flexibility of the magnetic sheets of Examples, in accordance with an embodiment of the present disclosure.

The relationship between the magnetic property and the flexibility was examined to demonstrate whether both magnetic property and the flexibility were at optimal levels at an annealing temperature of 300° C. to 400° C. (573 to 673 K). The results are shown in FIG. 7A. Flat alloy particles having a composition of No. 10 in Table 1 were mixed with a silicone resin to prepare material mixtures respectively containing 40 vol. %, 50 vol. %, 55 vol. %, and 60 vol. % of the particles. Each material mixture was formed into noise suppression sheets (magnetic sheets) having a thickness of about 0.1 mm. The resulting magnetic sheets were annealed at various temperatures as described above, and the imaginary part μ" of the complex permeability at 1 GHz and the fracture strain λf of the magnetic sheets were determined as described above.

The region A in FIG. 7A may be a region where optimal magnetic property and flexibility are exhibited. As shown in FIG. 7A, the majority of the region B1 where the magnetic sheets having a composition of No. 10 lay overlapped the region A. In other words, the magnetic sheets of this Example exhibited excellent magnetic property (imaginary part μ" of complex permeability) and excellent flexibility at an annealing temperature of 400° C. (673 K) or lower.

Flat alloy particles were prepared as in Example but from a magnetic alloy having a composition of No. 26 of Table 1 outside the range of the present disclosure. The glass transition temperature (Tg) and the crystallization temperature (Tx) of the resulting Fe-based amorphous magnetic alloy particles were examined as in Example. The glass transition temperature was 472° C. (745 K), and the crystallization temperature (Tx) was 503° C. (776 K).

The Fe-based amorphous magnetic alloy particles were mixed with a silicone resin to prepare a mixture having a Fe-based amorphous magnetic alloy content of 44 vol. %, and the mixture was formed into sheets as in Example. The sheets were annealed at Ta=300° C. to 420° C. (573 to 693 K) to obtain magnetic sheets of Sample No. 26. These magnetic sheets (Comparative Example 1) annealed at temperatures described above were analyzed as in Example to determine the imaginary part μ" of the complex permeability at 1 GHz and the fracture strain λf. The results are shown in FIGS. 5 and 6.

As shown in FIG. 5 the magnetic sheets of Comparative Example 1 annealed at 360° C. (633 K) or less exhibited an imaginary part μ" of complex permeability at 1 GHz of less than 15, which may not satisfy a level for practical application. The fracture strain λf was comparable to that of Examples, as shown in FIG. 6.

Figure 7B:
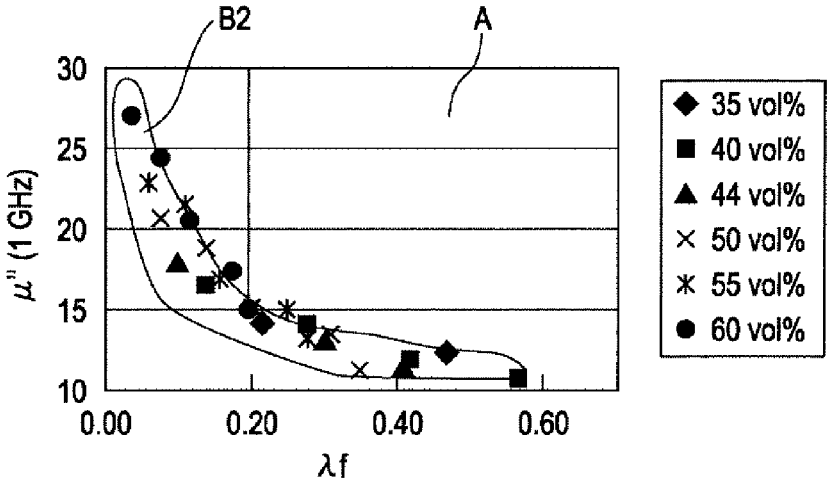
FIG. 7B depicts a graph showing the relationship between the region where the magnetic property and the flexibility are at desired levels and the region covering the magnetic property and the flexibility of the magnetic sheets of Comparative Example 1, in accordance with an embodiment of the present disclosure.

To investigate whether both the magnetic property and the flexibility were excellent, the relationship between the magnetic property and the flexibility of magnetic sheets annealed at 300° C. to 400° C. (573 to 673 K) was determined. The results are shown in FIG. 7B. The Fe-based amorphous magnetic alloy particles were mixed into a silicone resin to prepare material mixtures containing 35 vol. %, 40 vol. %, 50 vol. %, 55 vol. %, and 60 vol. % of the alloy, respectively, and each material mixture was formed into sheets to prepare noise suppression sheets (magnetic sheets) having a thickness of about 0.1 mm. The magnetic sheets were annealed at various temperatures as described above, and the imaginary part μ" of complex permeability at 1 GHz and the fracture strain λf of each magnetic sheet were determined as described above.

As shown in FIG. 7B, the region B2 where the magnetic sheets of Sample No. 26 lay had no portion overlapping the region A where the magnetic property and the flexibility were desirable. In other words, the magnetic sheets of Sample No. 26 did not simultaneously achieve the desired magnetic property (imaginary part μ" of complex permeability) and the flexibility at an annealing temperature of 400° C. (673 K) or less.

A magnetic alloy having a composition of No. 27 of Table 1 outside the range of the present disclosure was used to form flat Fe-based amorphous magnetic alloy particles. The Fe-based amorphous magnetic alloy particles were analyzed as in Example to determine the glass transition temperature (Tg) and the crystallization temperature (Tx). The glass transition temperature (Tg) was 511° C. (784 K) and the crystallization temperature (Tx) was 561° C. (834 K).

The Fe-based amorphous magnetic alloy particles were mixed with a silicone resin to prepare a mixture having a Fe-based amorphous magnetic alloy content of 44 vol. %, and the mixture was formed into sheets. The sheets were annealed at Ta=300° C. to 420° C. (573 to 693 K) to prepare magnetic sheets of Comparative Example 2. Each magnetic sheet of Comparative Example 2 annealed at the above-described temperature was analyzed as in Example to determine the imaginary part μ" of complex permeability at 1 GHz and the fracture strain λf. The results are shown in FIGS. 5 and 6.

As shown in FIG. 5, the magnetic sheets of Comparative Example 2 annealed at a temperature of 380° C. or less exhibited an imaginary part μ" of complex permeability at 1 GHz of less than 15, which did not satisfy the practical level. As shown in FIG. 6, the fracture strain λf was comparable to that of Example.

Figure 7C:
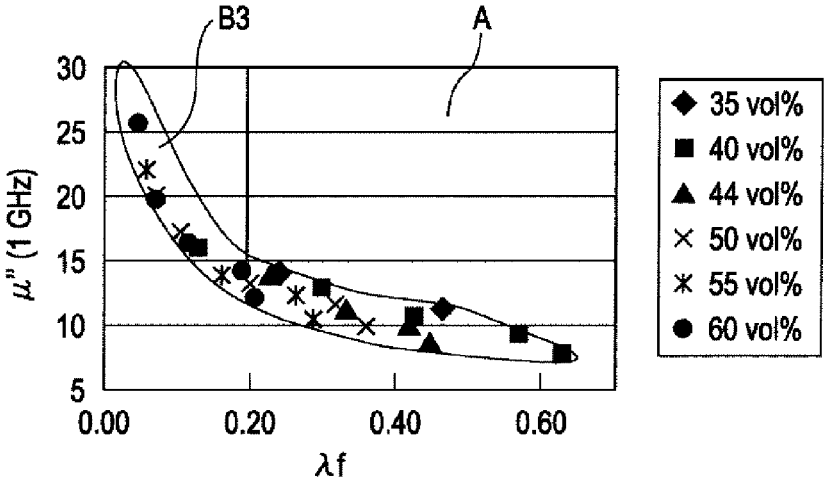
FIG. 7C depicts a graph showing the relationship between the region where the magnetic property and the flexibility are at desired levels and the region covering the magnetic property and the flexibility of the magnetic sheets of Comparative Example 2, in accordance with an embodiment of the present disclosure.

To investigate whether both the magnetic property and the flexibility were excellent, the relationship between the magnetic property and the flexibility of magnetic sheets annealed at 300° C. to 400° C. (573 to 673 K) was determined. The results are shown in FIG. 7C. The Fe-based amorphous magnetic alloy particles were mixed into a silicone resin to prepare material mixtures containing 35 vol. %, 40 vol. %, 50 vol. %, 55 vol. %, and 60 vol. % of the alloy, respectively, and each material mixture was formed into sheets to prepare noise suppression sheets (magnetic sheets) having a thickness of about 0.1 mm. The magnetic sheets were annealed at various temperatures as described above, and the imaginary part μ" of complex permeability at 1 GHz and the fracture strain λf of each magnetic sheet were determined as described above.

As shown in FIG. 7C, the region B3 where the magnetic sheet having a composition of No. 27 lay had no portion overlapping the region A where the magnetic property and the flexibility were desirable. In other words, the magnetic sheet having the composition of No. 27 did not simultaneously achieve the optimal magnetic property (imaginary part μ" of complex permeability) and the desirable flexibility at an annealing temperature of 400° C. or less.

Experimental Example 5

Ni Content

The crystallization temperature (Tx) and the melting temperature (Tm) were measured while varying the Ni content x in the composition $Fe_{74.4-x}Ni_xSn_{1.5}Cr_4P_{10.8}B_2Si_1$ from 0 to 12 at. %. The results are shown in Table 4 and FIGS. 8A and 8B. Note that the Fe-based amorphous magnetic alloy particles were prepared as in the experimental example above.

Figure 8A:
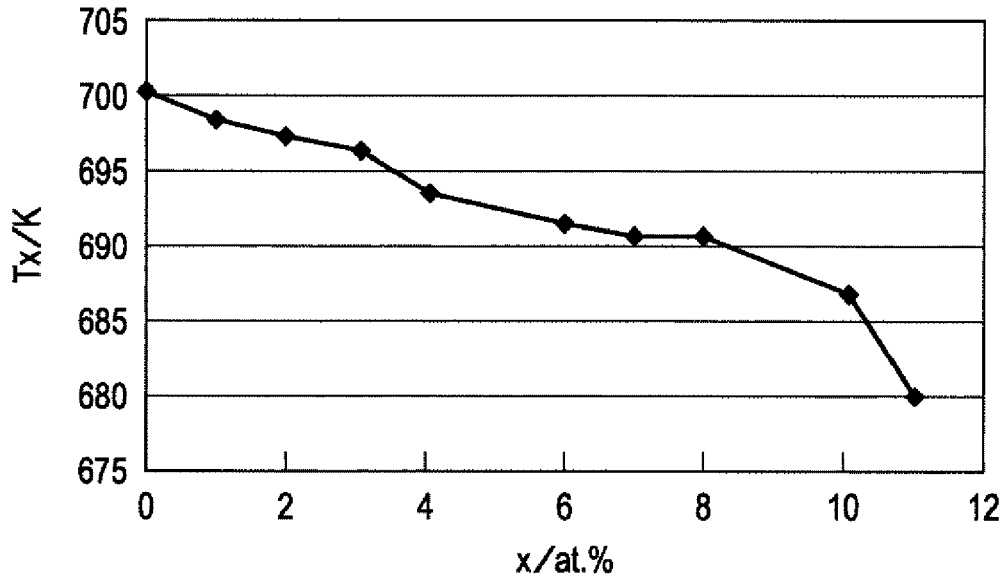
FIG. 8A depicts a graph showing the dependency of the crystallization temperature (Tx) on the Ni content, in accordance with an embodiment of the present disclosure.
Figure 8B:
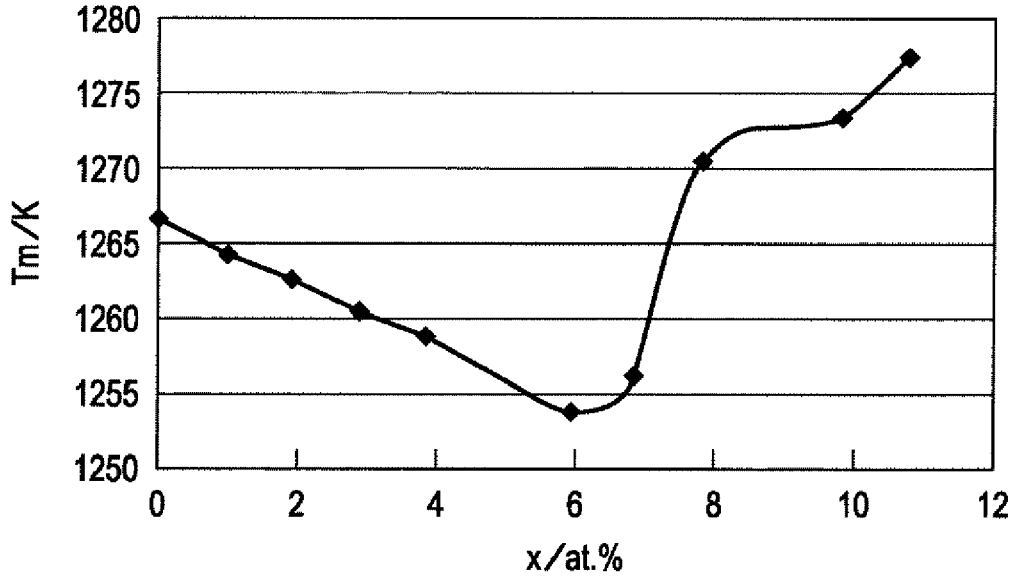
FIG. 8B depicts a graph showing the dependency of the melting temperature (Tm) on the Ni content, in accordance with an embodiment of the present disclosure.

As shown in FIG. 8A, the crystallization temperature (Tx) decreased with an increase in Ni content. It may be assumed that the annealing temperature may be decreased by increasing the Ni content. However, as shown in FIG. 8B, although the melting temperature (Tm) decreased by increasing the Ni content, it rapidly increased after the Ni content exceeded 7 at. %. This may render formation of amorphous phases difficult. Table 4 shows that the value of Tx/Tm may be become less than 0.55 at a Ni content of 8 at. % or more and is 0.53 at a Ni content of 11 at. % and that formation of amorphous phases may become increasingly difficult with an increase in Ni content.

TABLE 4

$Fe_{74.4-x}Ni_xSn_{1.5}Cr_4P_{10.8}C_{6.3}B_2Si_1$

| x | Tc/K | Tx/K | Tm/K | Tx/Tm | σs(wbm/kg) × $10^{-6}$ |
|---|---|---|---|---|---|
| 0 | 498 | 701 | 1266 | 0.55 | 169 |
| 1 | 502 | 699 | 1264 | 0.55 | 166 |
| 2 | 506 | 698 | 1262 | 0.55 | 168 |
| 3 | 511 | 697 | 1260 | 0.55 | 168 |
| 4 | 514 | 694 | 1258 | 0.55 | 166 |
| 6 | 520 | 692 | 1253 | 0.55 | 166 |
| 7 | 520 | 691 | 1255 | 0.55 | 163 |
| 8 | 521 | 691 | 1270 | 0.54 | 158 |
| 10 | 525 | 687 | 1273 | 0.54 | 157 |
| 11 | 530 | 680 | 1277 | 0.53 | 156 |

The above results demonstrate that the Ni content may be 1 at. % or more and 10 at. % or less to stably obtain an amorphous alloy, and/or more specifically, 2 at. % or more and 7 at. % or less, if lowering of the melting temperature is also required.

Experimental Example 6

Cr Content

The crystallization temperature (Tx) and the melting temperature (Tm) were measured while varying the Cr content x in the composition $Fe_{74.4-x}Cr_xSn_{1.5}Ni_6P_{10.6}C_{6.3}B_2Si_1$ from 0 to 12 at. %. The results are shown in Table 5 and FIGS. 9A, 9B, and 9C. Note that the Fe-based amorphous magnetic alloy particles were prepared as in the experimental examples above.

TABLE 5

$Fe_{74.4-x}Cr_xSn_{1.5}Ni_6P_{10.8}C_{6.3}B_2Si_1$

| x | Tc/° C. | Tg/° C. | Tx/° C. | ΔTx/° C. | Tm/° C. | Tg/Tm | Tx/Tm | σs/$10^{-6}$ |
|---|---|---|---|---|---|---|---|---|
| 0 | 607 | 422 | 438 | 16 | 967 | 0.56 | 0.57 | 200 |
| 1 | 314 | 422 | 441 | 19 | 966 | 0.56 | 0.58 | 188 |
| 2 | 292 | 422 | 443 | 21 | 970 | 0.56 | 0.58 | 177 |
| 3 | 268 | 424 | 446 | 22 | 976 | 0.56 | 0.58 | 169 |
| 4 | 247 | 424 | 449 | 25 | 980 | 0.56 | 0.58 | 166 |
| 6 | 213 | 424 | 452 | 28 | 988 | 0.55 | 0.57 | 144 |
| 8 | 202 | 428 | 456 | 28 | 998 | 0.55 | 0.57 | 124 |
| 10 | 158 | 433 | 467 | 34 | 1006 | 0.55 | 0.58 | 97 |
| 12 | 133 | 435 | 469 | 34 | 1017 | 0.55 | 0.58 | 80 |

Figure 9A:
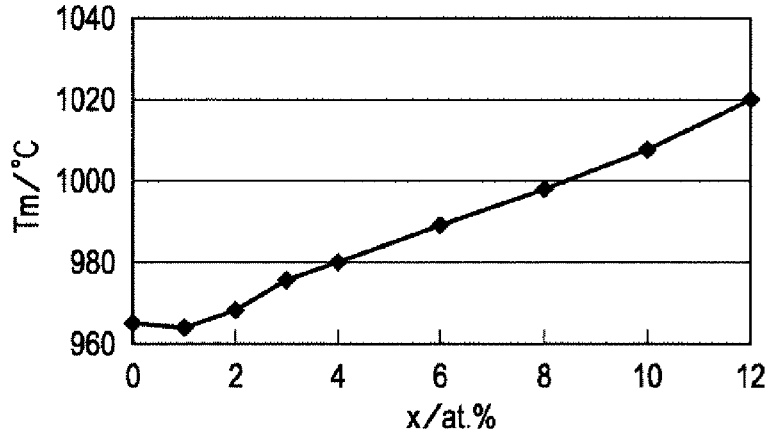
FIG. 9A depicts a graph showing the dependency of the melting temperature (Tm) on the Cr content, in accordance with an embodiment of the present disclosure.
Figure 9B:
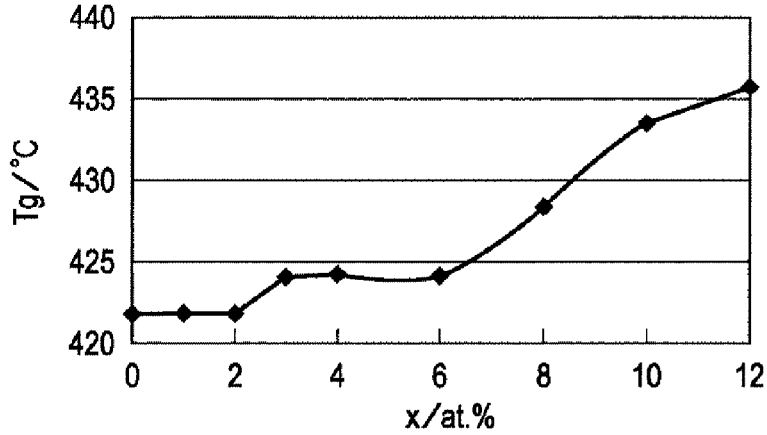
FIG. 9B depicts a graph showing the dependency of the glass transition temperature (Tg) on the Cr content, in accordance with an embodiment of the present disclosure.
Figure 9C:
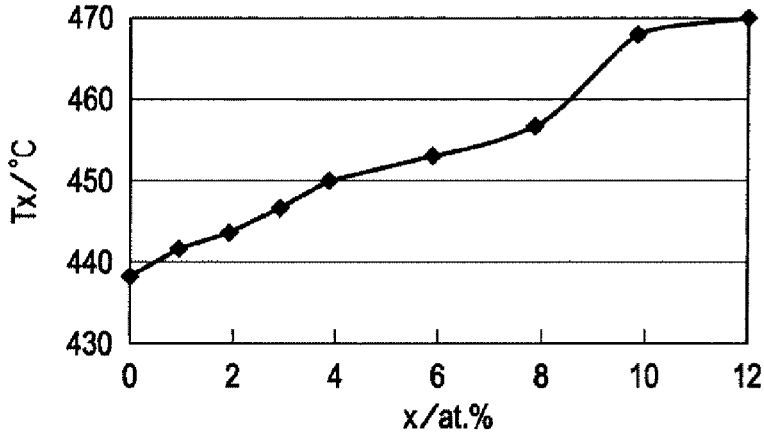
FIG. 9C depicts a graph showing the dependency of the crystallization temperature (Tx) on the Cr content, in accordance with an embodiment of the present disclosure.

As shown in FIGS. 9A, 9B, and 9C, the melting temperature (Tm), the glass transition temperature (Tg), and the crystallization temperature (Tx) increased with the Cr content, thereby allowing the annealing temperature to also increase. As shown in Table 4, the saturation magnetization (σs) may be lower. On the other hand, chromium may be an additive essential for corrosion resistance in forming the Fe-based amorphous magnetic alloy particles by water atomization or the like. Chromium may also be essential for preventing deterioration and changes over time of the sheet characteristics by corrosion of the alloy powder and the like.

Thus, the Cr content may be 0 at. % or more and 8 at. % or less to increase the crystallization temperature (Tx). When corrosion resistance is necessary, such as when water atomization is employed, the Cr content may be required to be 2 at. % or more. Since this decreases saturation magnetization (σs), the Cr content may be limited to 4 at % or less.

The present disclosure is not limited by the embodiments and examples described above. Various modifications, alterations, and changes are possible without departing the range of the present disclosure. For example, the types and amounts of constituent components, the process of blending the materials, the process conditions, and the like may be varied within the range of the present disclosure.

What is claimed is:

1. A magnetic sheet comprising:

a matrix material; and an Fe-based amorphous magnetic alloy comprising a low temperature annealing-enabling element M at an amount of is 1 at. % or more and 4 at. % or less, 1 at. % or more and 10 at. % or less of nickel (Ni), wherein the low temperature annealing-enabling element M is at least one of tin (Sn), Indium (In), zinc (Zn), and gallium (Ga), wherein a total amount of the low temperature annealing-enabling element M and nickel (Ni) is 2 at. % or more and 10 at. % or less and wherein the Fe-based amorphous magnetic alloy is contained in the matrix material, wherein the Fe-based amorphous magnetic alloy has a composition represented by a compositional formula, $Fe_{100-a-b-x-y-z-w-t}M_aNi_bCr_xP_yC_zB_wSi_t$(1≦a≦4 at. %, 1≦b≦10 at. %, 0≦x≦8 at. %, 6 at. %≦y≦13 at. %, 2 at. %≦z≦12 at. %, 0≦w≦5 at. %, and 0≦t≦4 at. %), and wherein crystallization temperature (Tx) ≦670 K is exhibited.

2. The magnetic sheet of claim 1, wherein the magnetic sheet has been annealed at a temperature of 400° C. or less.

3. The magnetic sheet of claim 1, wherein, in the compositional formula, 1≦a≦4 at. %, 1≦b≦10 at. %, 2≦a+b≦10 at. %, 1≦x≦8 at. %, 6≦y≦11 at. %, 6≦z≦11 at. %, 0≦w≦2 at. %, and 0≦t≦2 at. %.

4. The magnetic sheet of claim 1, wherein, in the compositional formula, 1.5≦a≦3.5 at. %, 2≦b≦7 at. %, 3≦a+b≦9.5, and 2≦x≦4 at. %.

5. The magnetic sheet of claim 4, wherein, in the compositional formula, 2.5≦a≦3.5 at. %, 4≦b≦7 at. %.

6. A magnetic sheet comprising:

a matrix material; and an Fe-based amorphous magnetic alloy comprising a low temperature annealing-enabling element M at an amount of is 1 at. % or more and 4 at. % or less, 1 at. % of more and 10 at. % or less of nickel (Ni), wherein the low temperature annealing-enabling element M is at least one of tin (Sn), Indium (In), zinc (Zn), and gallium (Ga), wherein a total amount of the low temperature annealing-enabling element M and nickel (Ni) is 2 at. % or more and 10 at. % or less and wherein the Fe-based amorphous magnetic alloy is contained in the matrix material, wherein the Fe-based amorphous magnetic alloy has a composition represented by a compositional formula, $Fe_{100-a-b-x-y-z-w-t}M_aNi_bCr_xP_yC_zB_wSi_t$(1≦a≦4 at. %, 1≦b≦10 at. %, 0≦x≦8 at. %, 6 at. %≦y≦13 at. %, 2 at. %≦z≦12 at. %, 0≦w≦5 at. %, and 0≦t≦4 at. %), and wherein a complex-permeability imaginary part (μ") at 1 GHz is between 20 and 24.

7. A magnetic sheet comprising:

a matrix material; and an Fe-based amorphous magnetic alloy comprising a low temperature annealing-enabling element M at an amount of is 1 at. % or more and 4 at. % or less, 1 at. % of more and 10 at. % or less of nickel (Ni), wherein the low temperature annealing-enabling element M is at least one of tin (Sn), Indium (In), zinc (Zn), and gallium (Ga), wherein a total amount of the low temperature annealing-enabling element M and nickel (Ni) is 2 at. % or more and 10 at. % or less and wherein the Fe-based amorphous magnetic alloy is contained in the matrix material, wherein the Fe-based amorphous magnetic alloy has a composition represented by a compositional formula, $Fe_{100-a-b-x-y-z-w-t}M_aNi_bCr_xP_yC_zB_wSi_t$($1 \leqq a \leqq 4$ at. %, $1 \leqq b \leqq 10$ at. %, $0 \leqq x \leqq 8$ at. %, 6 at. % $\leqq y \leqq 13$ at. %, 2 at. % $\leqq z \leqq 12$ at. %, $0 \leqq w \leqq 5$ at. %, and $0 \leqq t \leqq 4$ at. %), and wherein fracture strain (λf) is between 0.2 and 0.35.

8. A magnetic sheet comprising:

a matrix material; and an Fe-based amorphous magnetic alloy comprising a low temperature annealing-enabling element M at an amount of is 1 at. % or more and 4 at. % or less, 1 at. % of more and 10 at. % or less of nickel (Ni), wherein the low temperature annealing-enabling element M is at least one of tin (Sn), Indium (In), zinc (Zn), and gallium (Ga), wherein a total amount of the low temperature annealing-enabling element M and nickel (Ni) is 2 at. % or more and 10 at. % or less and wherein the Fe-based amorphous magnetic alloy is contained in the matrix material, wherein the Fe-based amorphous magnetic alloy has a composition represented by a compositional formula, $Fe_{100-a-b-x-y-z-w-t}M_aNi_bCr_xP_yC_zB_wSi_t$($1 \leqq a \leqq 4$ at. %, $1 \leqq b \leqq 10$ at. %, $0 \leqq x \leqq 8$ at. %, 6 at. % $\leqq y \leqq 13$ at. %, 2 at. % $\leqq z \leqq 12$ at. %, $0 \leqq w \leqq 5$ at. %, and $0 \leqq t \leqq 4$ at. %), wherein crystallization temperature (Tx) $\leqq 670$ K is exhibited, wherein a complex-permeability imaginary part (μ") at 1 GHz is between 20 and 24, and wherein fracture strain (λf) is between 0.2 and 0.35.

* * * * *